US006786195B2

(12) United States Patent
Doelker

(10) Patent No.: US 6,786,195 B2
(45) Date of Patent: Sep. 7, 2004

(54) METHOD OF CONTROLLING THE ROTATIONAL SPEED OF A DRIVE UNIT

(75) Inventor: Armin Doelker, Immenstaad (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 0 days.

(21) Appl. No.: 10/686,706

(22) Filed: Oct. 17, 2003

(65) Prior Publication Data

US 2004/0079329 A1 Apr. 29, 2004

(30) Foreign Application Priority Data

Oct. 18, 2002 (DE) ..... 102 48 633

(51) Int. Cl.[7] ..... F02D 41/06; F02D 41/08

(52) U.S. Cl. ..... 123/339.21; 123/179.16; 123/491

(58) Field of Search ..... 123/339.21, 179.16, 123/491, 680, 685

(56) References Cited

U.S. PATENT DOCUMENTS 5,251,598 A * 10/1993 Wietelmann ..... 123/339.21
5,758,308 A * 5/1998 Maki et al. ..... 123/491

FOREIGN PATENT DOCUMENTS

DE 197 11 787 A1 3/1997

* cited by examiner

*Primary Examiner*—Erick R. Solis
(74) *Attorney, Agent, or Firm*—Crowell & Moring LLP

(57) ABSTRACT

In a method of controlling a drive unit, particularly an internal-combustion engine generator unit, in addition to first and second controlling devices, a third controlling device is provided for computing a third injection quantity. One of the controlling devices is set as dominant for controlling the rotational speed. From an operator determined charge definition, a charge injection quantity is computed, and is compared with the injection quantity of the dominant controlling device. As a function of the comparison, the dominance of the controlling device is retained or the charge definition is set to be dominant for a power-determining signal.

18 Claims, 12 Drawing Sheets

METHOD OF CONTROLLING THE ROTATIONAL SPEED OF A DRIVE UNIT

BACKGROUND AND SUMMARY OF THE INVENTION

This application claims the priority of German patent document 102 48 633.6, filed 18 Oct. 2002, the disclosure of which is expressly incorporated by reference herein.

The present invention relates to a method of controlling the rotational speed of a drive unit, particularly an internal-combustion engine generator unit.

To control the rotational speed of a drive unit, a first rotational-speed controlling device is provided to control the idling speed, together with a second rotational-speed controlling device to control the final speed. (As used herein, the term "drive unit" applies to an internal-combustion engine generator unit as well as to an internal-combustion engine transmission unit.) To control the rotational speed of the drive unit, the dominant controlling device computes a control variable, such as an injection quantity, from a desired-actual comparison. However, the reaction times of such a control circuit structure in the case of a sudden load change, and the transition from the first to the second controlling device or vice-versa, are problematic in that undesirable overswings may occur.

To improve the performance of such a system in this regard, according to German Patent Document DE 197 11 787 A1, in the case of small control deviations, the first controlling device is dominant, while the second controlling device is dominant in the case of large control deviations. To reduce the overswings, during the transition from the second to the first controlling device, the integrating fraction of the first controlling device is initialized. Regardless of which of the two controlling devices is dominant, both simultaneously compute their respective control variables, which results in high computing expenditures. Likewise, it is a problem that, except by defining the desired value, the operator of the drive unit can exercise no direct influence, for example, during the starting operation.

One object of the present invention is to provide a method of controlling the rotational speed of a drive unit, in which the starting operation is also taken into account.

This and other objects and advantages are achieved by the method and apparatus according to the invention in which a third controlling device is provided for computing a third injection quantity to control the rotational speed of the starting operation. In addition, the user of the drive unit can directly intervene by defining a charge, and the charge definition is used to compute a charge injection quantity which is compared with the injection quantity of the dominant controlling device. Based on the comparison, either the dominance of the controlling device is retained or the charge definition is set to be dominant for a power-determining signal. (In the sense used herein, the power-determining signal is either an injection quantity or the control path of a control rod.)

According to the invention, the controlling devices which are not dominant are deactivated. Because only the dominant controlling device is therefore active, a clear software structure is achieved, and computer capacity is freed.

In the case of an internal-combustion engine generator unit, the first controlling device controls idling rotational speed, while the second controls final rotational speed and the third controls starting rotational speed. The first injection quantity is the idling rotational speed injection quantity; the second injection quantity is the final rotational speed injection quantity; and the third injection quantity is a starting rotational speed injection quantity. In the case of a dominant charge definition, it is checked as a function of the actual rotational speed of the drive unit whether the idling rotational speed controlling device or the final rotational speed controlling device is activated. During a change, for example, to the idling rotational speed controlling device, its integrating fraction (I-fraction) is initialized, which achieves low overswing ranges during the transition.

During a starting operation, initially the starting rotational speed controlling device is dominant, and a check is made whether the charge injection quantity is larger than the starting rotational speed injection quantity. Based on the result of this comparison, the end of a starting condition is detected, and the idling rotational speed controlling device is then set to be dominant as the charge definition. Due to the possibility of a charge definition as early as in the starting operation, a faster run-up of the drive unit is achieved.

Other objects, advantages and novel features of the present invention will become apparent from the following detailed description of the invention when considered in conjunction with the accompanying drawings.

DETAILED DESCRIPTION OF THE DRAWINGS

Figure 1:
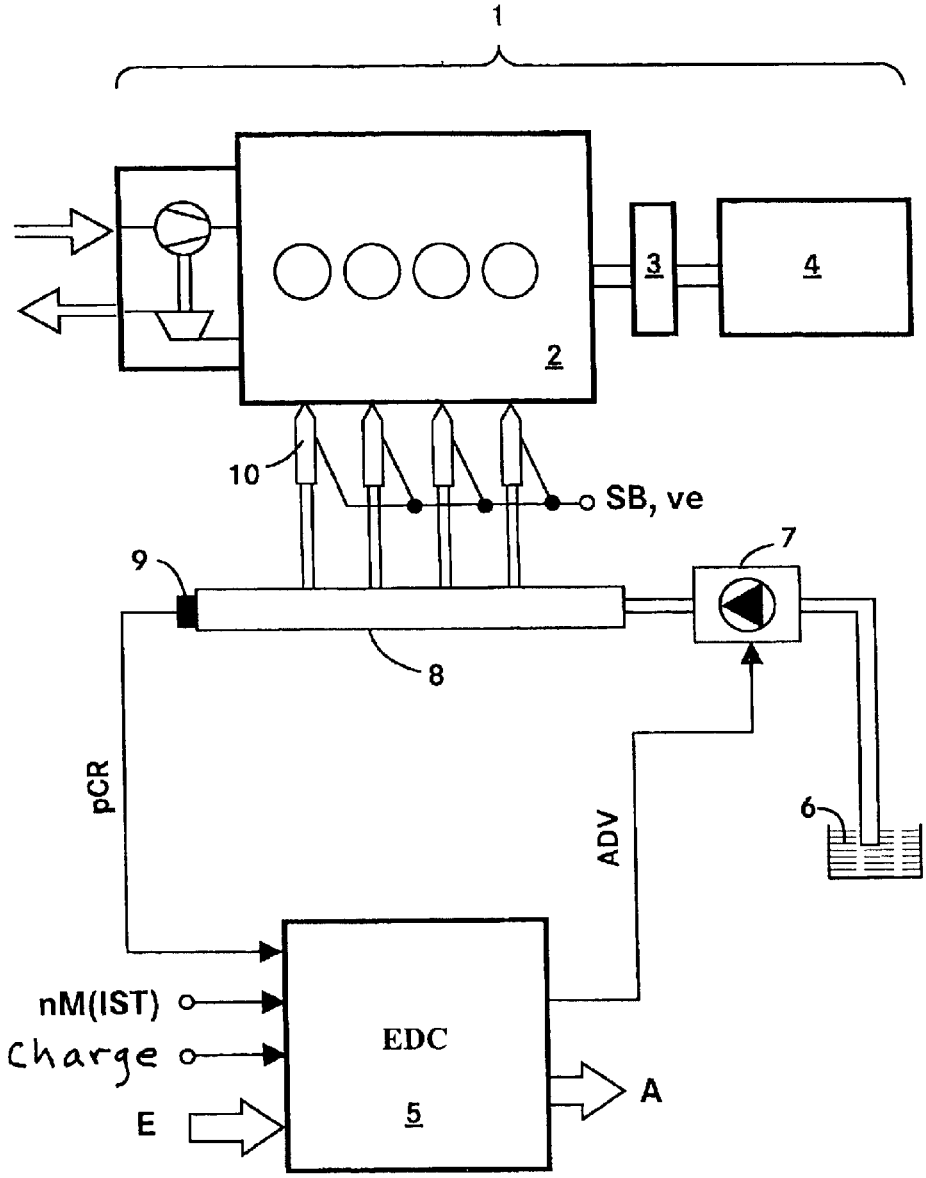
FIG. 1 is a system diagram of the control arrangement according to the invention.

FIG. 1 is a system diagram of the overall system of a drive unit, for example, an internal-combustion engine generator unit 1. The latter consists of an internal-combustion engine 2 having a generator 4. The internal-combustion engine 2 drives the generator 4 by way of a shaft having a transmission member 3. In practice, the transmission member 3 may contain a free wheel. In the case of the illustrated internal-combustion engine 2, the fuel is injected by way of a common rail system which includes pumps 7 (with a suction throttle for delivering the fuel from a fuel tank 6), a rail 8 for storing the fuel, and injectors 10 for injecting the fuel from the rail 8 into the combustion chambers of the internal-combustion engine 2.

The method of operation of the internal-combustion engine 2 is controlled by an electronic control unit (EDC) 5, which may be a conventional microcomputer system including, for example, a microprocessor, I/O modules, buffers and memory chips (EEPROM, RAM). In the memory chips, the operating data relevant to operation of the internal-combustion engine 2 are applied in characteristic diagrams/characteristic curves, which are used by the electronic control unit 5 to compute the output quantities from the input quantities. As an example, FIG. 1 shows the following input quantities: a rail pressure pCR, which is measured by means of a rail pressure sensor 9; an actual rotational speed signal nM(ACTUAL) of the internal-combustion engine 2; an input quantity E, and a signal CHARGE for the charge definition for the drive unit.

The charge definition CHARGE is defined by the operator. In the case of an internal-combustion engine generator unit, this may be an analog signal. By way of the charge definition CHARGE, the operator can have a direct influence on the drive unit. In the case of a vehicle application, this corresponds to the accelerator pedal position. (The charge air pressure of a turbocharger and the temperatures of the coolant/lubricant and of the fuel, for example, are subsumed by the input quantity E.)

FIG. 1 shows a signal ADV for controlling the pumps 7 with the suction throttle and an output quantity A as the output quantities of the electronic control unit 5. The output quantity A represents the additional control signals for controlling and regulating the internal-combustion engine 2, for example, the injection start SB and the power-determining signal ve, corresponding to the injection quantity.

Figure 2:
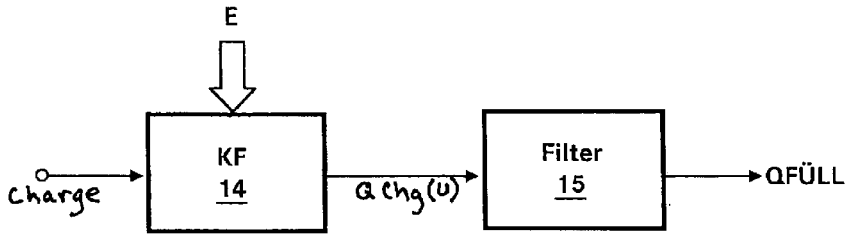
FIG. 2 is a block diagram of the charge injection quantity computation.

FIG. 2 is a block diagram for converting the charge definition CHARGE to a charge injection quantity QCHARGE. For this purpose, the charge definition CHARGE is first converted, by means of a characteristic curve or a characteristic diagram 14, to an unfiltered charge injection quantity QCHARGE(U). During this conversion, additional input quantities (combined as reference symbol E) may be taken into account, such as the actual rotational speed nM(ACTUAL) of the internal-combustion engine 2. The unfiltered charge injection quantity QCHARGE(U) is then converted by way of a filter 15 to the charge injection quantity QCHARGE.

Figure 3:
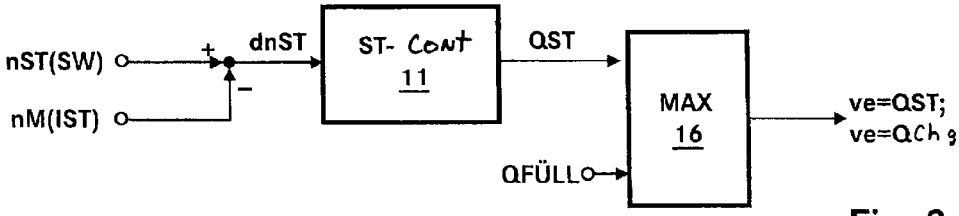
FIGS. 3, 4, 5 are views of a control circuit structure.

FIG. 3 shows a control circuit structure for the starting operation. By means of this control circuit structure, the power-determining signal ve of the internal-combustion engine for the starting operation is computed. The input quantities correspond to the actual rotational speed nM(ACTUAL) of the internal-combustion engine and a desired starting rotational speed value nST(SW). In the case of an internal-combustion engine generator unit, the desired starting rotational speed value nST(SW) is increased after the starting of the internal-combustion engine in a ramp shape to an idling rotational speed.

A control deviation dnST is obtained from the two input quantities, and is used by the starting rotational speed controlling device 11 to compute the starting rotational speed injection quantity QST. The starting rotational speed injection quantity QST and the charge injection quantity QCHARGE represent the input quantities of the maximal-value selection block 16. The latter determines the maximal value from the two input quantities and sets the power-determining signal ve of the internal-combustion engine to the maximal value. The power-determining signal ve therefore corresponds either to the charge injection quantity QCHARGE or to the starting rotational speed injection quantity QST.

Figure 4:
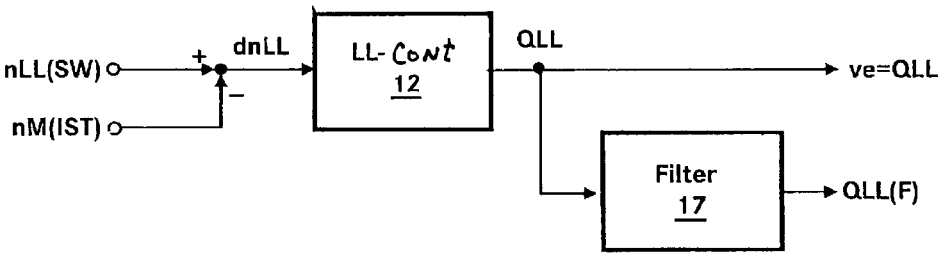

FIG. 4 shows a control circuit structure of the idling rotational speed controlling device 12 for computing the power-determining signal ve. The idling rotational speed controlling device 12 has a rotational speed control deviation dnLL as an input quantity and an idling rotational speed injection quantity QLL as an output quantity. The rotational speed control deviation dnLL is obtained from the difference between the actual rotational speed nM(ACTUAL) and a desired value of the idling rotational speed nLL(SW). When the idling rotational speed controlling device 12 is dominant, the power-determining signal ve is set to the value of the idling rotational speed injection quantity QLL. The latter represents the input quantity of a filter 17. By way of the filter 17, a filtered idling rotational speed injection quantity QLL(F) is computed from the idling rotational speed injection quantity QLL. The filtered idling rotational speed injection quantity QLL(F) is then used during the checking of the transition from the idling rotational speed controlling device 12 to the charge definition CHARGE.

Figure 5:
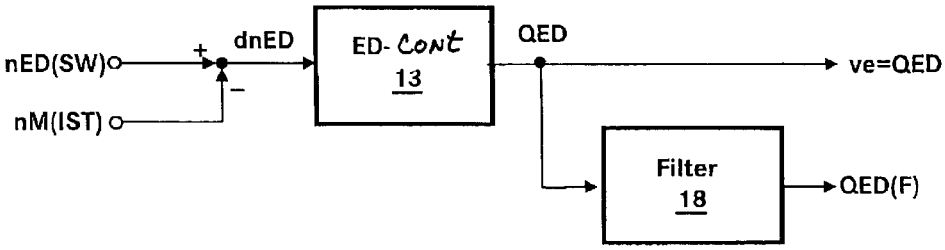

FIG. 5 shows a control circuit structure of the final rotational speed controlling device 13 for computing the power-determining signal ve when the final rotational speed controlling device is dominant. From a rotational speed control deviation dnED as the output quantity, the final rotational speed controlling device 13 computes a final rotational speed injection quantity QED. The rotational speed control deviation dnED, in turn, is obtained from the difference between the actual rotational speed nM(ACTUAL) of the internal-combustion engine and a desired value of the final rotational speed nED(SW). When the final rotational speed controlling device 13 is dominant, the power-determining signal ve is set to the value of the final rotational speed injection quantity QED, which constitutes the input quantity of a filter 18. The filter 18 computes a filtered final rotational speed injection quantity QED(F) that is used in checking the transition from the final rotational speed controlling device 13 to the charge definition CHARGE.

In contrast to the prior art, according to the invention, only one rotational speed controlling device is dominant (that is, computes the control quantity) and only one is activated. The rotational speed controlling devices that are not dominant are deactivated and perform no computing operations. For example, when the idling rotational speed controlling device 12 is dominant, only the latter computes an injection quantity (here, the idling rotational speed injection quantity QLL). For computing the control quantities, the rotational speed controlling devices contain a corresponding control algorithm, such as a PIDT1-algorithm.

Figure 6:
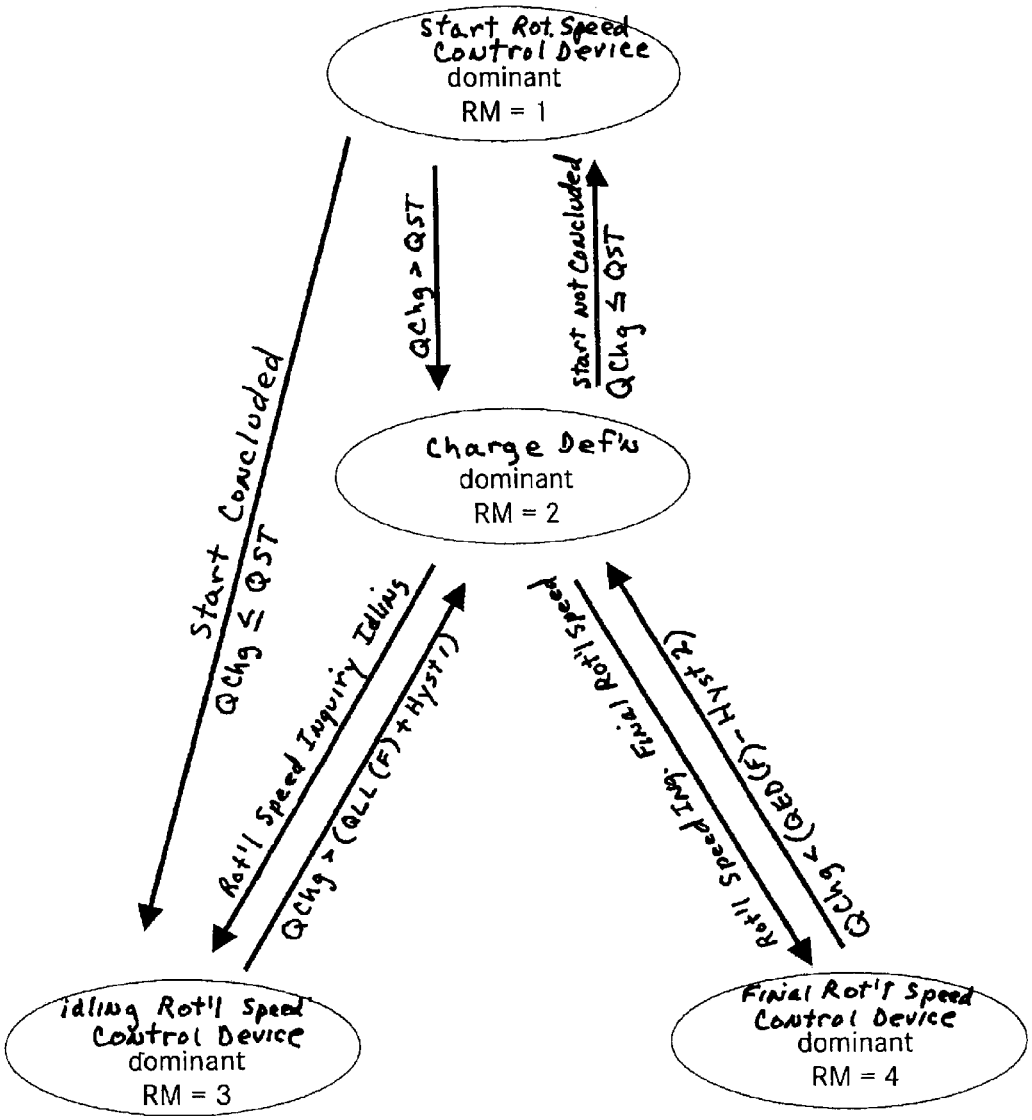
FIG. 6 is a view of a condition diagram.

FIG. 6 is a condition diagram for the four conditions of the internal-combustion engine generator unit 1. During the starting operation, the starting rotational speed controlling device is dominant first. The dominance is imaged by way of the controlling device mode RM signal. When the starting rotational speed controlling device 11 is dominant, the controlling device mode RM corresponds to the value one (RM=1). After starting the internal-combustion engine 2, starting operation is active until the actual rotational speed nM(ACTUAL) of the internal-combustion engine 2 exceeds the idling rotational speed (for example, 1,450 1/min).

During the starting operation, it is determined whether the charge injection quantity QCHARGE becomes larger than the starting rotational speed injection quantity QST. If not, the starting rotational speed controlling device remains dominant (RM=1). Simultaneously, the power-determining signal ve is set to the value of the starting rotational speed injection quantity QST (ve=QST). Upon detection of the starting end, the idling rotational speed controlling device 12 is activated (RM=3). If it is detected during the starting operation that the charge injection quantity QCHARGE is larger than the starting rotational speed injection quantity QST, the charge definition CHARGE is set as dominant by way of the controlling device mode RM (RM=2). Simultaneously, the power-determining signal ve is set to the value of the charge injection quantity QCHARGE.

A return to the starting rotational speed controlling device 11 takes place when the charge injection quantity QCHARGE again becomes smaller than or equal to the starting rotational speed injection quantity QST.

In the case of a dominant charge definition CHARGE and a starting end, a rotational speed inquiry of the actual rotational speed nM(ACTUAL) is made, to determine whether a change in the dominance is to take place toward the idling rotational speed controlling device 12 or toward the final rotational speed controlling device 13. A return from the idling rotational speed controlling device 12 to the charge definition CHARGE takes place by comparing the charge injection quantity QCHARGE with the sum of the idling rotational speed injection quantity QLL or the filtered idling rotational speed injection quantity QLL(F) and a hysteresis value Hyst1. A return from the final rotational speed controlling device 13 to the charge definition CHARGE takes place by comparing the charge injection quantity QCHARGE with the difference from the final rotational speed injection quantity QED or filtered final rotational speed injection quantity QED(F) minus a hysteresis value Hyst2. By using the filtered idling rotational speed injection quantity QLL(F) and the filtered final rotational speed injection quantity QED(F), a particularly stable transition is achieved.

Figure 7:
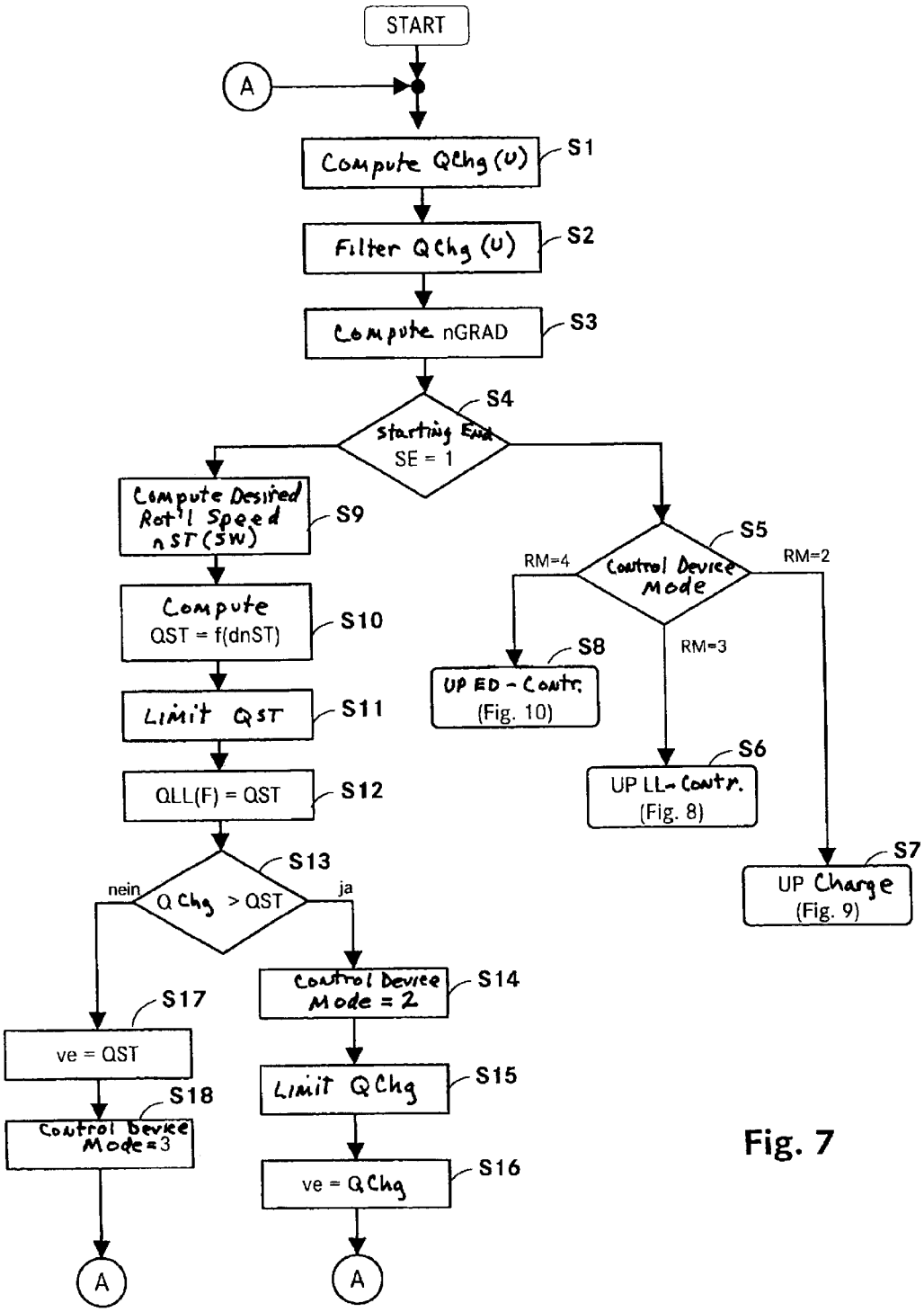
FIG. 7 is a flow chart for the starting operation.

FIG. 7 shows a flow chart for the starting operation. At S1, the unfiltered charge injection quantity QCHARGE(U) is computed from the charge definition CHARGE and is filtered at S2. Subsequently, at S3, from the actual rotational speed nM(ACTUAL), its gradient nGRAD is computed. At S4, it is checked whether a starting end condition SE is detected. If a start has not yet been completed, the program branch with the Steps S9 to S18 is implemented, while if a starting end is detected, the Steps S5 to S8 are implemented.

If no starting end condition has yet been detected in S4 (SE=0), in S9, the desired value nST(SW) of the starting rotational controlling device 11 is computed, and is used to form, a run-up ramp or a constant value is formed. In S10, the starting rotational speed injection quantity QST is computed as a function of the actual rotational speed nM(ACTUAL) or the control deviation dnST. In S11, the computed starting rotational speed injection quantity is limited to a maximal value. In S12, the starting rotational speed injection quantity QST is set as the initialization value for the filtered idling rotational speed injection quantity QLL(F). In S13, it is determined whether the charge injection quantity QCHARGE becomes larger than the starting rotational speed injection quantity QST. If not, at S17 the starting rotational speed injection quantity QST is set as the power-determining signal ve and the controlling device mode RM is set to 3 in S18, a return to program point A takes place (that is, with the new computing of the charge injection quantity QCHARGE in Step S1).

If an increased charge injection quantity QCHARGE is detected in S13, the controlling device mode RM is set to 2 in Step S14. In S15, the charge injection quantity QCHARGE is then limited to a maximal value, and in S16, the charge injection quantity QCHARGE is set as a power-determining signal ve. Subsequently, the reentry to Point A takes place.

Figure 8:
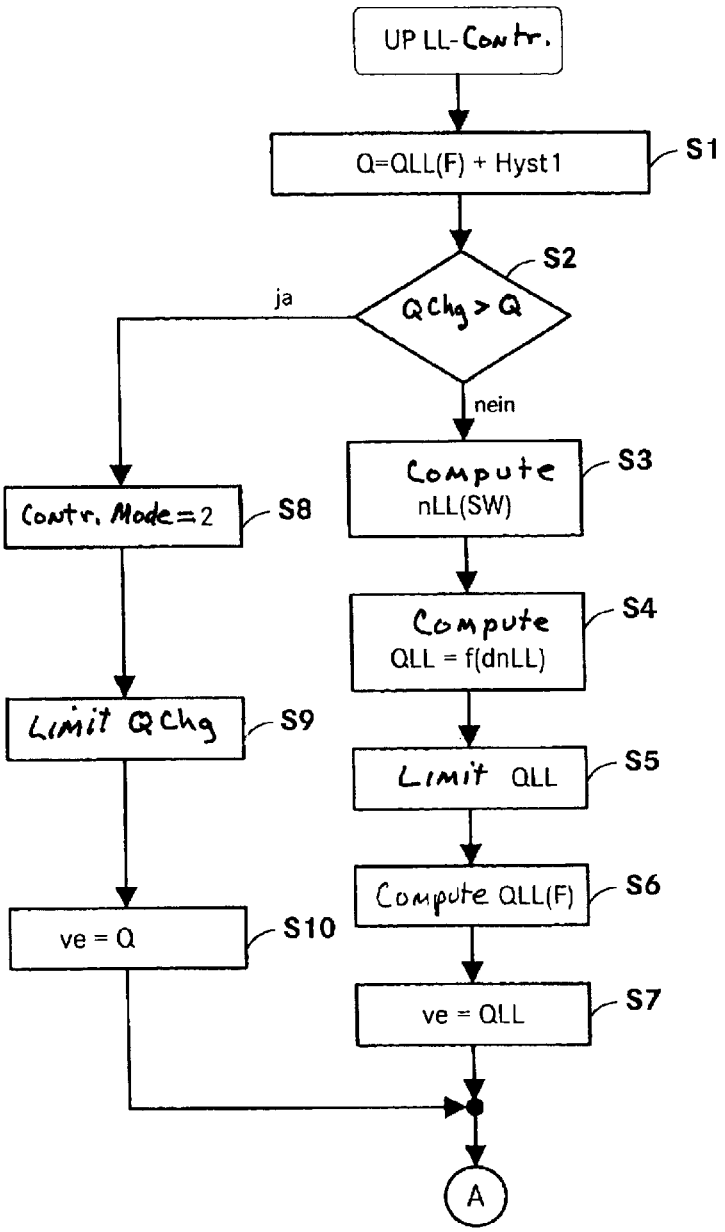
FIG. 8 is a flow chart for the subroutine idling rotational speed controlling device.
Figure 9:
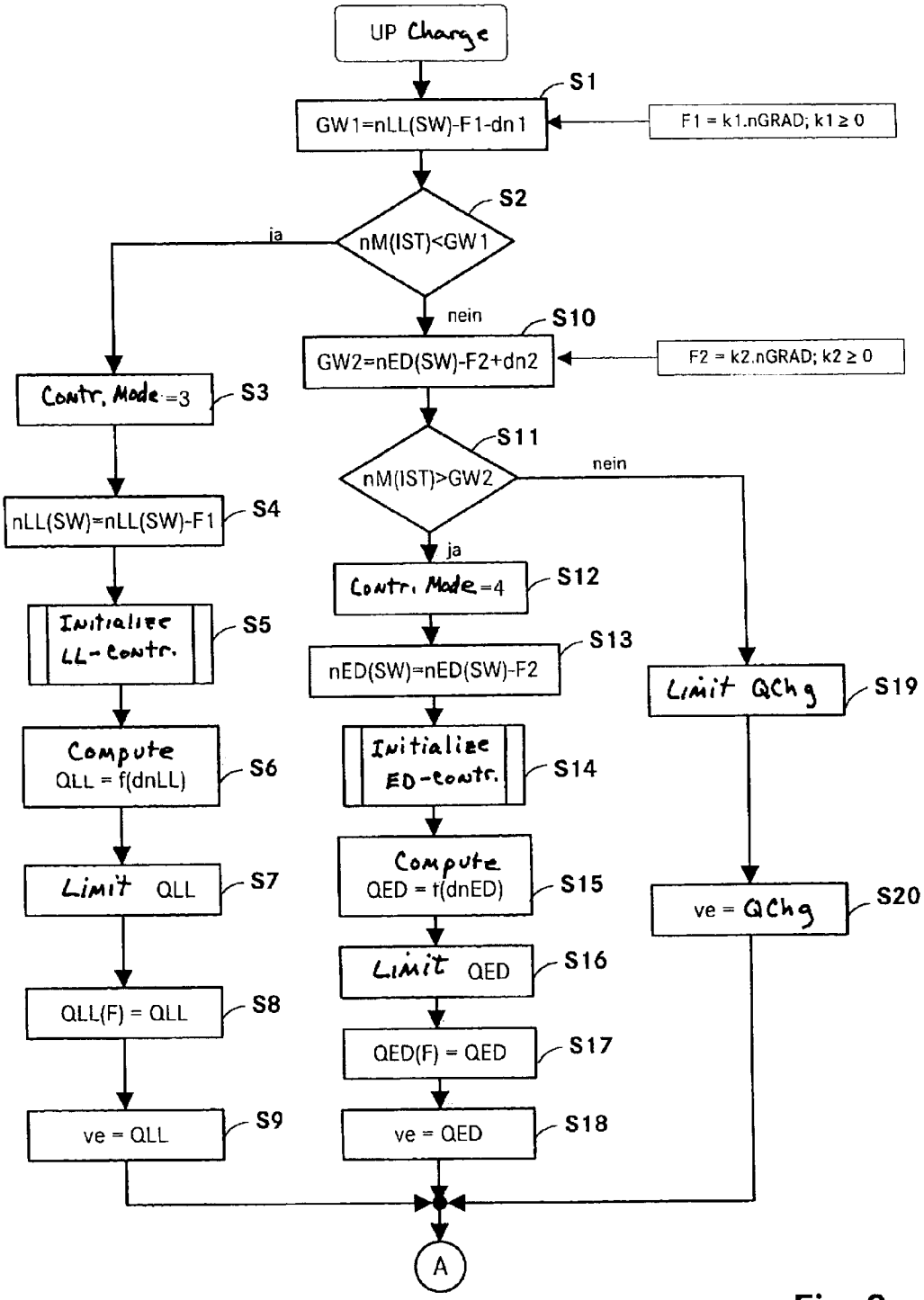
FIG. 9 is a flow chart for the charge subroutine.
Figure 10:
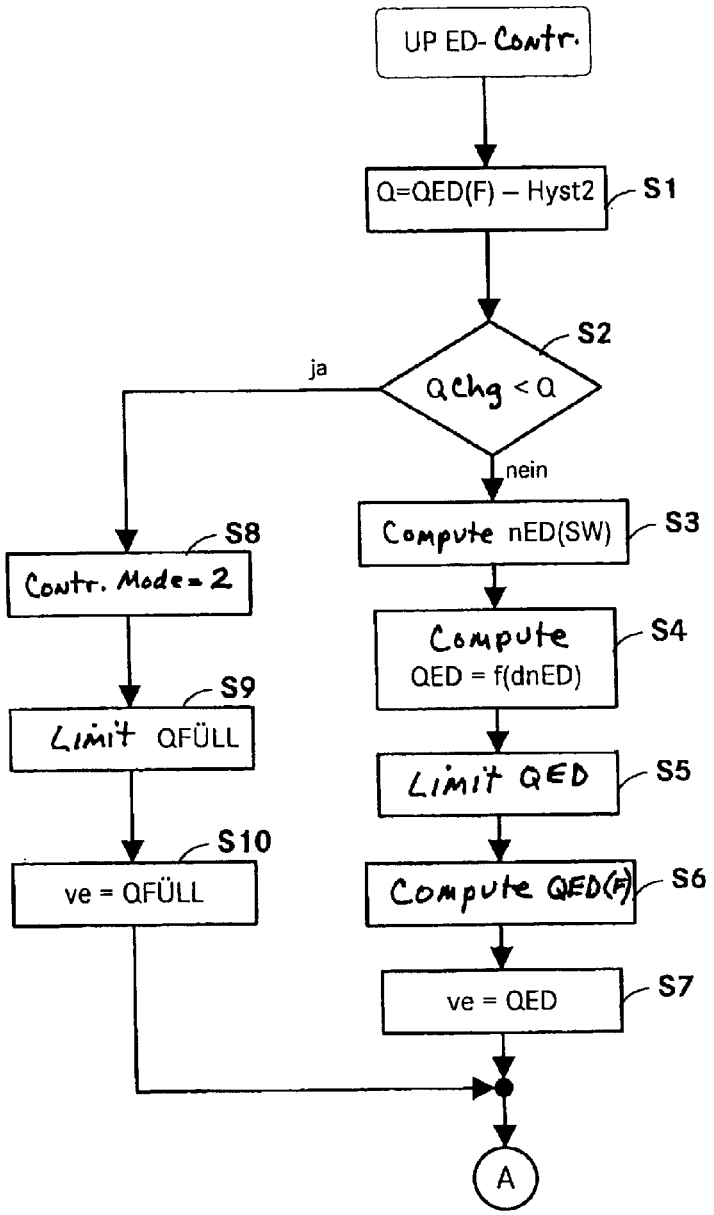
FIG. 10 is a flow chart for the final rotational speed controlling device subroutine.

When a starting end condition is detected (SE=1) in Step S4, an inquiry is made in S5 concerning the controlling device mode RM. If the latter has the value 3, in S6, the subroutine idling rotational speed controlling device corresponding to FIG. 8 is called. At a value of 2, in S7, the charge subroutine corresponding to FIG. 9 is called. At a value of 4, the subroutine final rotational speed controlling device corresponding to FIG. 10 is called.

FIG. 8 is a flow chart for the idling rotational speed controlling device 12 subroutine. In S1, an injection quantity Q is computed from the sum of the filtered idling rotational speed injection quantity QLL(F) and a hysteresis Hyst1, provided by the operator. By using the filtered idling rotational speed injection quantity QLL(F), and by the introduction of the hysteresis Hyst1, a particularly stable transition is achieved from the idling rotational speed controlling device 12 to the charge definition CHARGE. Then it is checked in S2 whether the charge injection quantity QCHARGE is becoming larger than the injection quantity Q. If the test result is positive, Steps S8 to S10 are implemented. If the test result is negative, Steps S3 to S7 are implemented.

When it is detected in S2 that the charge injection quantity QCHARGE is larger than the injection quantity Q, in S8, the controlling device mode RM is set to 2, and the charge injection quantity QCHARGE is limited in S9. Subsequently the charge injection quantity QCHARGE is set as a power-determining signal ve in S10, and the process returns to Point A of FIG. 7.

If it is detected in S2 that the charge injection quantity QCHARGE is smaller than or equal to the injection quantity Q, a desired value nLL(SW) for the idling rotational speed controlling device 12 is computed in S3. In practice, the desired value nLL(SW) may be constant; for example, 1,450 rotations per minute. In S4, the control deviation dnLL is computed as a function of the actual rotational speed nM(ACTUAL) and the desired value nLL(SW), and the idling rotational speed injection quantity QLL is computed from the control deviation dnLL. The computation can take place, for example, by means of a PIDT1 algorithm. In S5, the idling rotational speed injection quantity QLL is limited to a maximal value and is filtered in S6. Subsequently, in S7, the idling rotational speed injection quantity QLL is set as a power-determining signal ve and a return takes place to Point A of FIG. 7.

FIG. 9 is a flow chart for the charge subroutine. In S1, a first limit value GW1 is computed from the desired value nLL(SW) for the idling rotational speed controlling device 12 and a rotational speed derivative action. The rotational speed derivative action, in turn, is determined from a factor F1 and a defined value dn1. The factor F1 is proportional to the gradient nGRAD of the actual rotational speed nM(ACTUAL). Both the proportionality factor k1 and the defined value dn1 are defined by the operator. In practice, values of from 0 to 20 rotations/minute are used. If the defined value dn1 is equal to zero and k1 is greater than zero, a transition to the idling rotational speed controlling device 12 takes place while the actual rotational speed nM(ACTUAL) is diminishing, even before the desired rotational speed nLL(SW) has been reached because, in this case, the rotational speed gradient nGRAD has a negative preceding sign. The same applies when the factor F1 is larger than the defined value dn1 while the actual rotational speed nM(ACTUAL) is diminishing. In S2, it is determined whether the actual rotational speed nM(ACTUAL) is lower than the first limit value GW1. If so, the idling rotational speed controlling device 12 is activated (RM=3), and the Steps S3 to S9 are implemented. If the actual rotational speed nM(ACTUAL) is higher than or equal to the limit value (GW1), Steps S10 to S20 are implemented.

When the actual rotational speed nM(ACTUAL) is below the first limit value GW1, the controlling device mode RM is set to 3 in Step 3. Subsequently, in S4 the desired value nLL(SW) of the idling rotational speed controlling device 12 is computed by subtracting the factor F1 from the desired value nLL(SW). When the actual rotational speed nM(ACTUAL) is decreasing, the desired value nLL(SW) increases if the proportionality factor k1 is greater than zero. In the further program flow, the desired value nLL(SW) is returned either in a ramp shape or by means of a transition function to the original level. (See Step S3 of FIG. 8.) This short-term increase of the desired rotational speed nLL(SW) during the transition to the idling rotational speed controlling device 12, while the actual rotational speed nM(ACTUAL) decreases, generates a positive rotational speed control deviation dnLL even before the originally defined desired rotational speed has been reached. During the transition to the idling rotational speed controlling device 12, the higher the value dn1, the larger the rotational speed control deviation dnLL. As a result, the underswing of the actual rotational speed nM(ACTUAL) during the transition to the idling rotational speed controlling device 12 can be reduced considerably.

The idling rotational speed controlling device 12 is initialized in S5. (The initialization of the integrating fraction (I-fraction) will be explained in connection with FIGS. 11A to 11C.) Subsequently, in S6, the idling rotational speed injection quantity QLL is computed from the control deviation dnLL and is limited in S7. In S8, the filtered idling rotational speed injection quantity QLL(F) is initialized with the value of the idling injection quantity QLL. In S9, the idling rotational speed injection quantity QLL is set as the power-determining signal ve and the process returns to program point A.

If it is determined in S2 that the actual rotational speed nM(ACTUAL) is larger than/equal to the first limit value GW1, in S10 a second limit value GW2 is computed from the desired value nED(SW) of the final rotational speed controlling device 13 and a rotational speed derivative action (which is determined from a factor F2 and a positive defined value dn2). The factor F2 is proportional to the gradient nGRAD of the actual rotational speed nM(ACTUAL), while the proportionality factor k2 is defined by the operator. The defined value dn2 is also defined by the operator and, in practice, assumes values of from 0 to 20 rotations per minute.

Subsequently, it is checked at S11 whether the actual rotational speed nM(ACTUAL) is higher than the second limit value GW2. If so, the controlling device mode RM is set to the value 4 in S12, and the final rotational speed controlling device 13 is activated.

When the defined value dn2 has the value of zero and k2 has a value which is larger than zero, a transition takes place to the final rotational speed controlling device 13 when the actual rotational speed nM(ACTUAL) is rising, even before the desired rotational speed nED(SW) is reached, because the rotational speed gradient nGRAD in this case has a positive preceding sign. The same applies when the factor F2 is larger than the defined value dn2 while the actual rotational speed nM (ACTUAL) is increasing.

In S13, the desired value nED(SW) is computed. Subtracting the factor F2 from the desired value nED(SW) of the final rotational speed controlling device 13 causes the desired value nED(SW) to decrease when the proportionality factor k2 is set to be larger than zero and the actual rotational speed nM(ACTUAL) increases.

In a further program flow, the desired value nED(SW) is returned either in a ramp shape or by means of a transition function to the original level, specifically in Step S3 of FIG. 10. As a result of this short-term reduction of the desired rotational speed nED(SW) during the transition to the final rotational speed controlling device 13, —while the actual rotational speed nM(ACTUAL) is rising—a rotational speed control deviation dnED is generated even before the originally intended desired rotational speed nED(SW) has been reached. During the transition to the final rotational speed controlling device 13, this rotational speed control deviation dnED is larger, the higher the defined value dn2. As a result, the overswing of the actual rotational speed nM(ACTUAL) actual rotational speed nM(ACTUAL) during the transition to the final rotational speed controlling device 13 is reduced significantly.

The final rotational speed controlling device 13 is initialized in S14. (The initialization of the I-fraction will be explained in connection with FIG. 12.) In S15, the final rotational speed injection quantity QED is computed as a function of the control deviation dnED, and is subsequently limited to a maximal value in S16. In S17, the filtered final rotational speed injection quantity QED(F) is initialized with the value of the final rotational speed injection quantity QED. In S18, the final rotational speed injection quantity QED is set as the power-determining signal ve and a branching takes place to the program point A.

When it is detected in S11 that the actual rotational speed nM(ACTUAL) is lower than/equal to the second limit value GW2, the charge injection quantity QCHARGE is limited in S19 and, in S20, is set as the power-determining signal ve, whereupon the process returns to program point A.

FIG. 10 shows a flow chart for the final rotational speed controlling device 13 subroutine. In S1, an injection quantity Q is computed from the filtered final rotational speed injection quantity QED(F) minus a hysteresis Hyst2. Subsequently, it is determined in S2 whether the charge injection quantity QCHARGE is smaller than the injection quantity Q. Taking into account the filtered final rotational speed injection quantity QED(F) and the hysteresis Hyst2 in Step S2 achieves a particularly stable transition. If the inquiry in S2 is positive, the controlling device mode RM is set to value 2 in Step 8, and the charge definition CHARGE is thus set to be dominant. Subsequently, in S9, the charge injection quantity QCHARGE is limited to a maximal value, and in S10 it is set to be the power-determining signal ve. A return then takes place to program point A.

When it is detected in Step S2 that the charge injection quantity QCHARGE is larger than or equal to the injection quantity Q, the desired value nED(SW) for the final rotational speed controlling device 13 is computed in S3. In Step S4, the final rotational speed injection quantity QED is computed from the rotational speed control deviation dnED, for example, by way of a PIDT1-Algorithm. In S5, the final rotational speed injection quantity QED is limited to a maximal value and is filtered in S6. Subsequently, the final rotational speed injection quantity QED is set in S7 as the power-determining signal ve, and the process returns to Point A of FIG. 7.

Figure 11A:
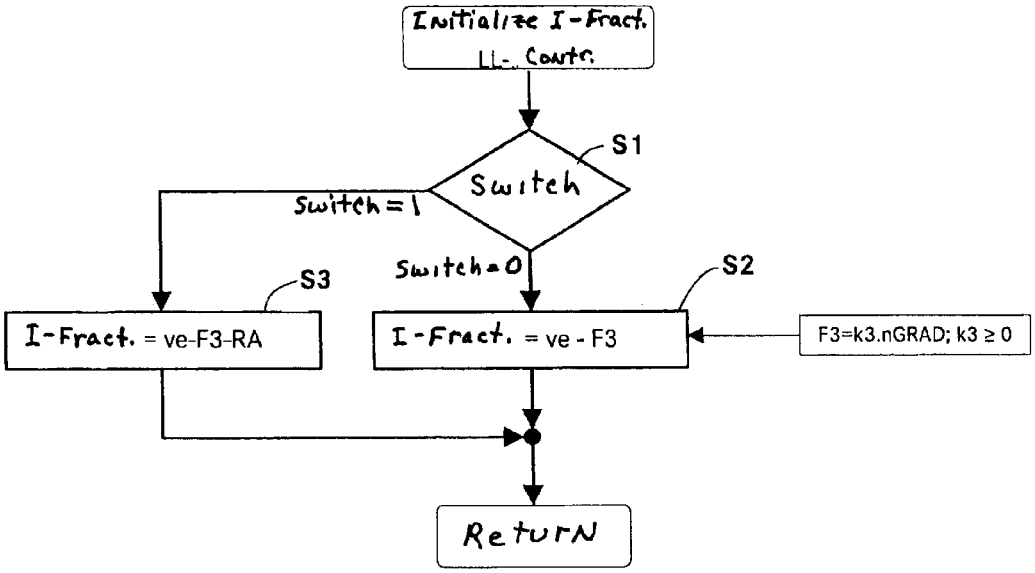
FIGS. 11A, B, C are views of the flow chart for initializing the idling rotational speed controlling device
Figure 11B:
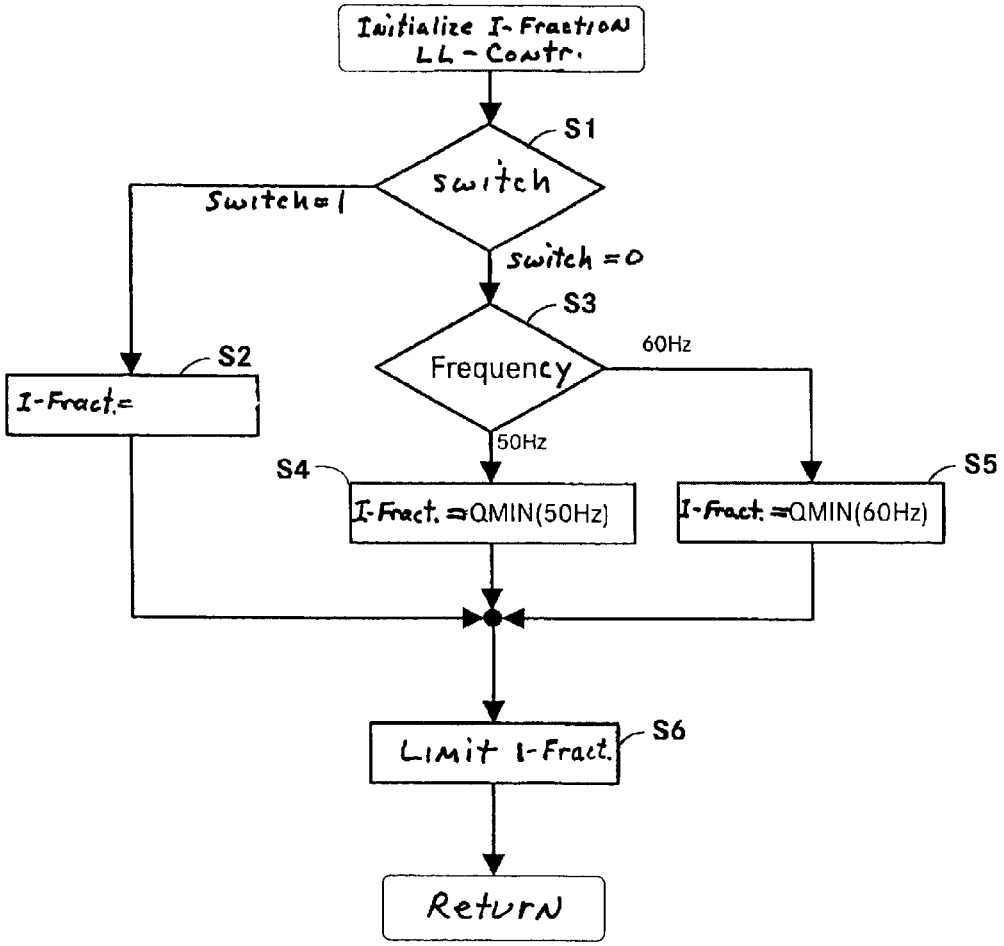
Figure 11C:
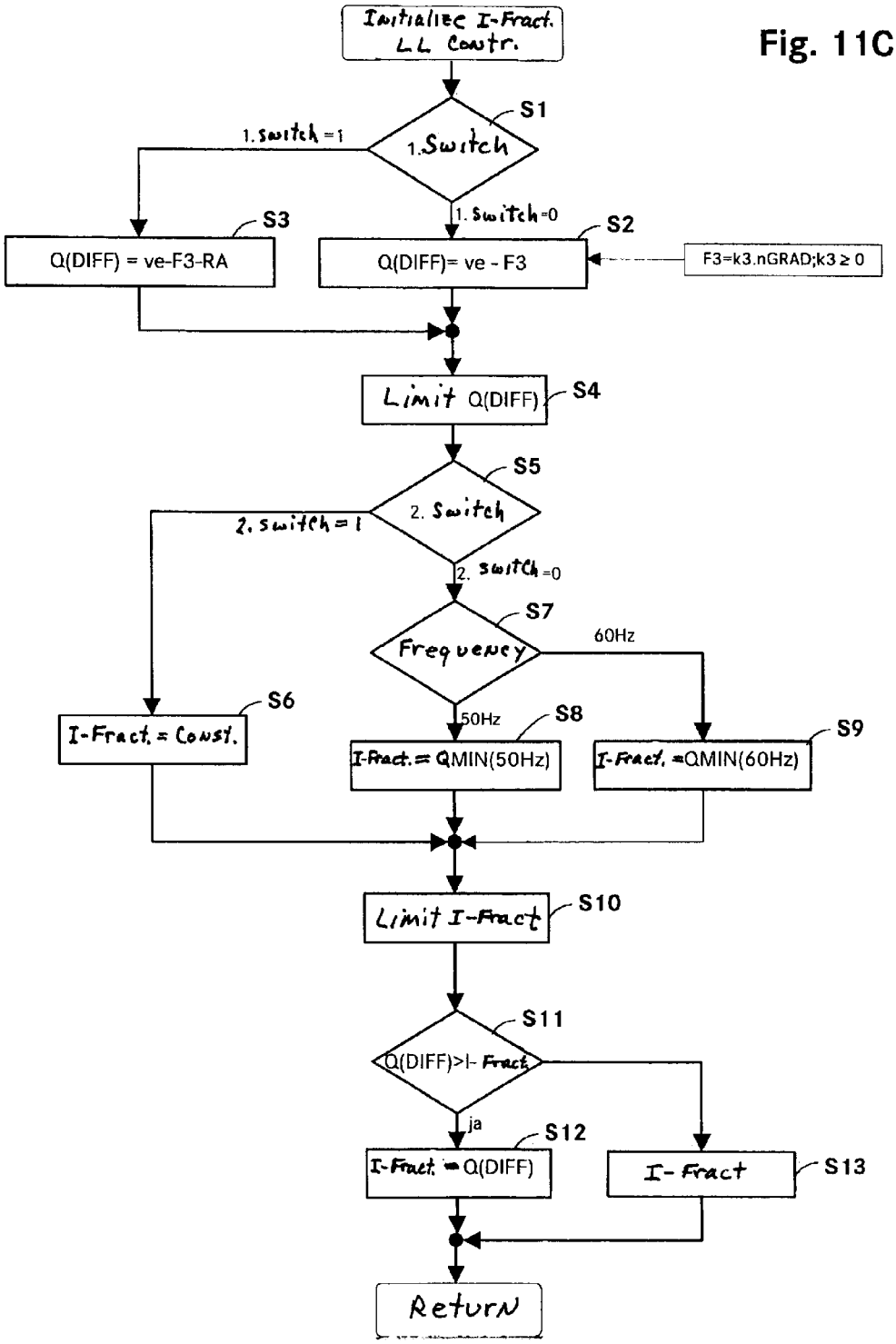

FIGS. 11A to 11C illustrate three embodiments for initialization of the integrating fraction (I-fraction) of the idling rotational speed controlling device 12. In FIG. 11A, the condition of a switch (which is set by the operator) is checked in S1. When it is set at a value of 1, the I-fraction is initialized in S3 by subtracting a factor F3 and a PIDT1 fraction RA of the idling rotational speed controlling device 12 from the actual value of the power-determining signal ve. The factor F3 is computed from the gradient nGRAD of the actual rotational speed nM(ACTUAL) and a positive proportionality factor k3. When a computation standard other than a PIDT1-algorithm is used, the fraction RA is equal to zero. On the other hand, when the switch has a value of 0, in S2, the I-fraction is initialized with the difference between the actual value of the power-determining signal ve and the factor F3. Thereupon the process returns to Step S5 of the flow chart of FIG. 9.

FIG. 11B shows another embodiment for initializing the I-fraction of the idling rotational speed controlling device 12. In contrast to FIG. 11*a*, here the I-fraction is defined. In S1, the setting of the switch (defined by the user) is determined. If the switch setting has the value 1, the I-fraction is set to a constant value in S2, and is limited in S6. The process then returns to the flow chart of FIG. 9. If the switch has the value 0, on the other hand, it is checked in S3 whether a 50 Hz or a 60 Hz generator is used. In both cases, the I fraction is initialized with the injection quantity occurring in the load-free operation of the internal-combustion engine. During 50 Hz operation, this corresponds to the injection quantity QMIN(50 Hz), while during 60 Hz operation it corresponds to the injection quantity QMIN(60 Hz). The I-fraction is then limited in S6, and a return takes place to the flow chart of FIG. 9.

FIG. 11C, which illustrates another embodiment for initializing the I-fraction of the idling rotational speed controlling device 12, corresponds essentially to the combination of the flow charts of FIGS. 11A and 11B. In S1, the switch condition of a first switch is checked. If the first switch has the value 1, a difference injection quantity Q(DIFF) is computed in S3, by subtracting a factor F3 and the PIDT1 fraction RA of the idling rotational speed controlling device from the actual value of the power-determining signal ve. The factor F3, in turn, represents the product of the gradient nGRAD of the actual rotational speed nM(ACTUAL) and the positive value k3 to be defined. If the first switch has the value 0, a difference injection quantity Q(DIFF) is also computed in S2, as the difference between the actual value of the power-determining signal ve and factor F3. In S4, the difference injection quantity Q(DIFF) is then limited.

In S5, the switch condition of a second switch is checked. If it has the value 1, in S6 the I-fraction will be set to a constant definable value. However, if the switch has the value of 0, Steps S7 to S9 follow. (These correspond to Steps S3 to S5 of FIG. 11B, so that what was indicated there applies here.) In S10, the I-fraction is then limited to a maximal value, and in S11 it is determined whether it is smaller than the difference injection quantity Q(DIFF). If not, the previously computed I-fraction is used as the initialization value in Step 13. If it is, on the other hand, the I-fraction is set to the difference injection quantity Q(DIFF) in S12, and the process returns to the flow chart of FIG. 9.

Figure 12:
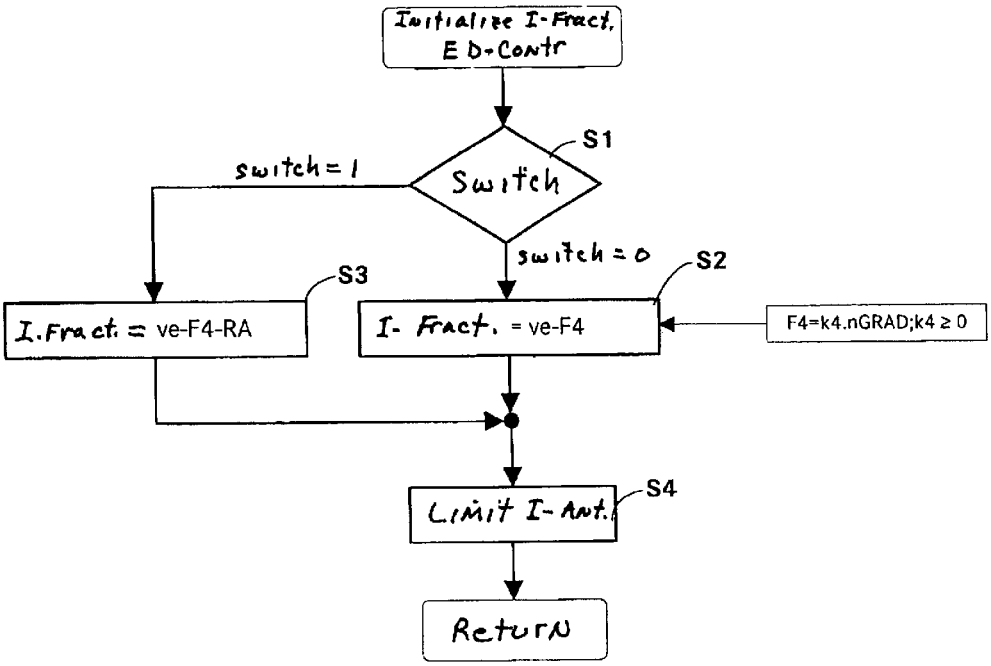
FIG. 12 is a flow chart for initializing the final rotational speed controlling device.

FIG. 12 is a flow chart for initializing the I-fraction of the final rotational speed controlling device 13. In S1, the switch condition of a switch is checked. If it has the value 1, the I-fraction is initialized in Step S3. The I-fraction is computed from the actual value of the power-determining signal ve minus a factor F4 and the PIDT1-fraction RA of the final rotational speed controlling device 13. In this case, the factor F4 is the product of the gradient nGRAD of the actual rotational speed nM(ACTUAL) and of a positive defined value k4. Subsequently, in S4, the previously computed I-fraction is limited. If, however, the switch has the value 0, the I-fraction is initialized in Step S2 with the difference between the actual value of the power-determining signal ve and the factor F4. After the implementation of Step S4, the process returns to the flow chart of FIG. 9.

Figure 13A:
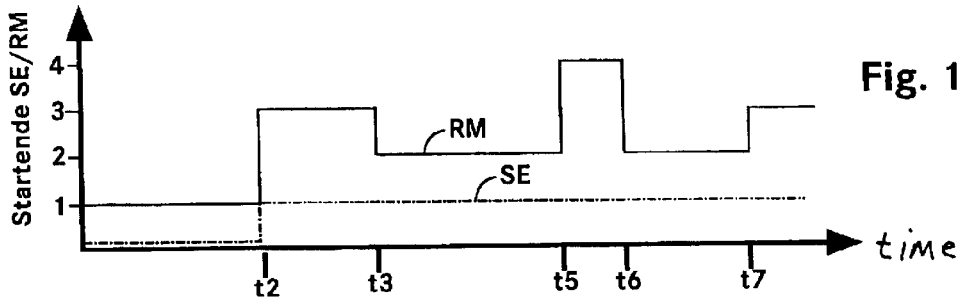
FIG. 13 is a time diagram.
Figure 13B:
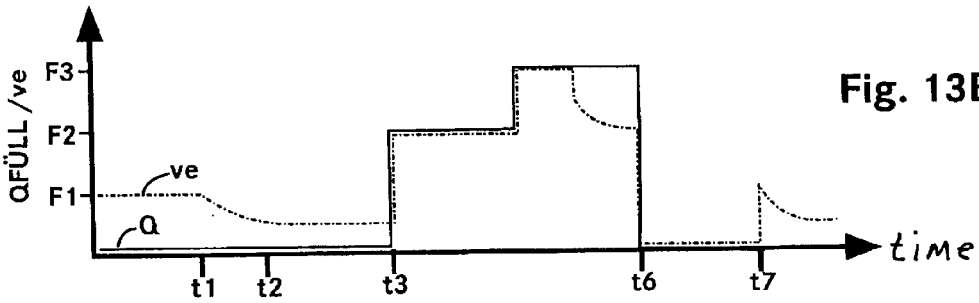
Figure 13C:
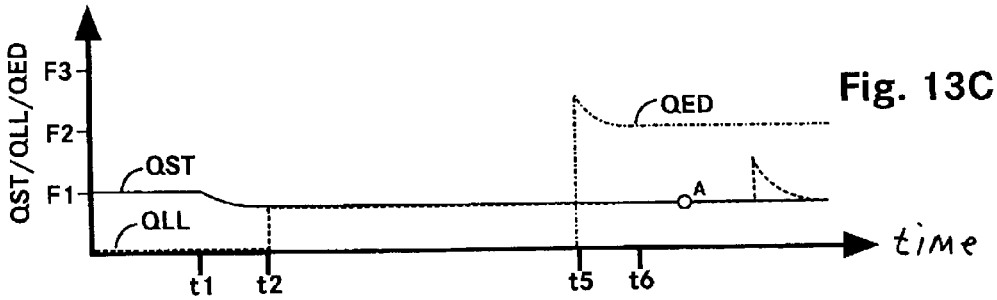
Figure 13D:
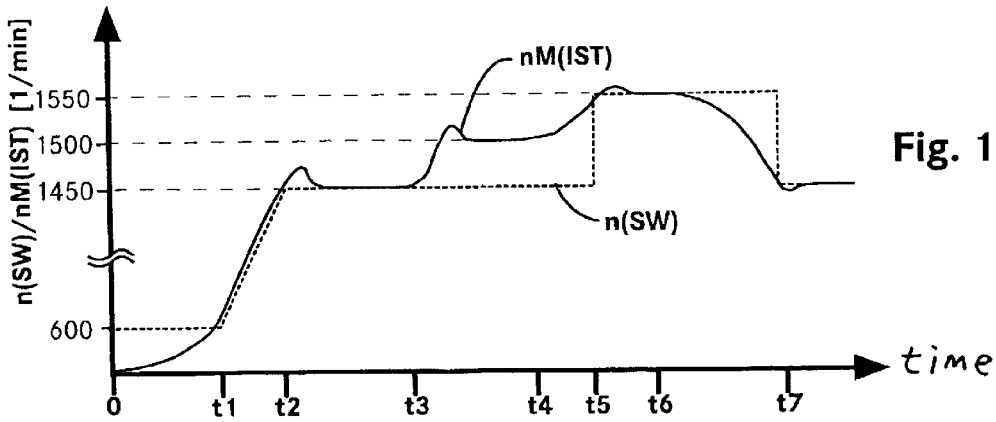

FIG. 13, which shows a starting operation with a subsequent idling and final rotational speed control, consists of partial FIGS. 13A to 13D. These each show the following as a function of the time: A starting end signal Se and the controlling device mode RM representing the dominance (FIG. 13A), the charge injection quantity QCHARGE and the power-determining signal ve (FIG. 13B), the starting rotational speed, idling rotational speed and final rotational speed injection quantities QST, QLL and QED (FIG. 13C) and a rotational speed diagram (FIG. 13D).

At a point in time t=0, the internal-combustion engine generator unit 1 is activated, and the starting end signal assumes a value 0. Simultaneously, the starting rotational speed controlling device is activated and is first set to be dominant. The controlling device mode signal RM has the value 1. At the same time, it is checked whether the charge injection quantity QCHARGE computed from the charge definition CHARGE is larger than the starting rotational speed injection quantity QST computed by the starting rotational speed controlling device 11. Since the charge injection quantity QCHARGE first has the value 0, the value of the power-determining signal ve corresponds to the value of the starting rotational speed injection quantity QST (here F1). The actual rotational speed nM(ACTUAL) follows a run-up ramp defined by way of the desired value nST(SW).

At the point in time t1, the actual rotational speed nM(ACTUAL) exceeds 600 rpm. (Until the point in time t1, the starting rotational speed injection quantity QST is limited to the value F1; subsequently, this will not longer be so.) At the point in time t2, the actual rotational speed nM(ACTUAL) reaches a limit value, whereby the starting end condition is met. The limit value is shown in FIG. 13D with 1,450 rpm. When this limit is reached, the starting end signal is set from 0 to 1. At the idling rotational speed of 1,450 rpm, there is not yet any power connection between the internal-combustion engine 2 and the generator 4.

Starting at the point in time t2, the idling rotational speed controlling device 12 is dominant, and controls the actual rotational speed nM(ACTUAL) to a constant value of 1,450 rpm. The power-determining signal ve is now equal to the idling rotational speed injection quantity QLL. At time t3, the charge definition CHARGE is increased, so that the charge injection quantity QCHARGE assumes the value F2 and therefore becomes larger than the idling rotational speed injection quantity QLL. As a result, the dominance will change from the idling rotational speed controlling device 12 to the charge definition CHARGE. This is illustrated in FIG. 13A by the change of the controlling device mode RM from value 3 to 2. In the time period t3 to t4, because of the higher charge injection quantity QCHARGE, the actual rotational speed nM(ACTUAL) is guided to a new rotational speed level of 1,500 rpm. As of this point in time, a power connection will exist.

At time t4, it is assumed that the charge definition CHARGE is increased again, which increases the charge injection quantity QCHARGE to the value F3. (It is assumed that the generator load has remained unchanged.) Because of the higher injection quantity, the actual rotational speed nM(ACTUAL) is also increased. At the point in time t5, the dominance changes from the charge definition CHARGE to the final rotational speed controlling device 13. The controlling device mode RM changes its value from 2 to 4. Now the power-determining signal ve corresponds to the final rotational speed injection quantity QED. Then, the final rotational speed injection quantity QED decreases to the point in time t6 at which, for example, the charge definition CHARGE is again reduced to zero. As a result, the charge injection quantity QCHARGE is also reduced to zero. Since this value is lower than the injection quantity QED computed by the final rotational speed controlling device 13, the charge definition CHARGE now becomes dominant. Correspondingly, the value of the controlling device mode RM will change back to the value of 2. Since the power-determining signal ve assumes the 0 value, the actual rotational speed nM(ACTUAL) is now decreasing. As of this point in time, there is no longer a power connection. Shortly before the limit value of 1,450 rpm is reached, the idling rotational speed controlling device 12 becomes dominant. The controlling device mode RM changes its value from 2 to 3. The actual rotational speed nM(ACTUAL) levels out to the idling rotational speed of 1,450 rpm.

FIG. 13D shows that the idling rotational speed (1,450 rpm) and the final rotational speed (1,550 rpm) are very close to one another. Generally, the invention can always be used advantageously when an idling final rotational speed control is required while the rotational speed levels are close to one another.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method of controlling the rotational speed of a drive unit, comprising:

a first controlling device computing a first injection quantity;

a second controlling device computing a second injection quantity;

a third controlling device computing a third injection quantity;

setting one of said controlling devices to be dominant, said dominant controlling device controlling the rotational speed;

deactivating controlling devices that are not dominant;

determining a charge injection quantity from a charge definition;

comparing an injection quantity of the dominant controlling device with the charge injection quantity; and as a function of the comparison, retaining the dominance of the dominant controlling device or setting the charge definition to be dominant for a power-determining signal.

2. The method of controlling the rotational speed according to claim 1, wherein:

the first controlling device is an idling rotational speed controlling device, and the first injection quantity is an idling rotational speed injection quantity;

the second controlling device is a final rotational speed controlling device, and the second injection quantity is a final rotational speed injection quantity; and the third controlling device is a starting rotational speed controlling device, and the third injection quantity is a starting rotational speed injection quantity.

3. The method of controlling the rotational speed according to claim 2, wherein the idling rotational speed injection quantity and the final rotational speed injection quantity are filtered.

4. The method of controlling the rotational speed according to claim 2, wherein the starting rotational speed controlling device is set to be dominant when existence of a starting condition is detected and the starting rotational speed injection quantity is larger than the charge injection quantity.

5. The method of controlling the rotational speed according to claim 4, wherein when the starting rotational speed controlling device is set as dominant, dominance changes to the idling rotational speed controlling device when a starting end condition is detected and the starting rotational speed injection quantity is larger than or equal to the charge injection quantity.

6. The method of controlling the rotational speed according to claim 4, wherein the charge definition is set as dominant when the charge injection quantity becomes larger than the starting rotational speed injection quantity and a starting end has not yet been detected.

7. The method of controlling the rotational speed according to claim 6, wherein when the charge definition is set as dominant, dominance changes back to the starting rotational speed controlling device when the charge injection quantity becomes smaller than or equal to the starting rotational speed injection quantity and a starting end has not yet been detected.

8. The method of controlling the rotational speed according to claim 7, wherein when the charge definition is set as dominant, dominance changes to the idling rotational speed controlling device when an actual rotational speed of the drive unit is lower than a first limit value.

9. The method of controlling the rotational speed according to claim 8, wherein:

the first limit value is computed from a desired value of an idling rotational speed (nLL(SW)) and a rotational speed derivative action; and the rotational speed derivative action is determined substantially by a gradient of the actual rotational speed and a defined value.

10. The method of controlling the rotational speed according to claim 8, wherein when the dominance is changed, an I-component of the idling rotational speed controlling device is initialized.

11. The method of controlling the rotational speed according to claim 10, wherein:

the initialization value of the I-component is set to be constant or is significantly determined by the gradient of the actual rotational speed.

12. The method of controlling the rotational speed according to claim 1, wherein:

when the idling rotational speed controlling device is set as dominant, dominance changes to the charge definition when the charge injection quantity becomes larger than the sum of the idling rotational speed injection quantity or the filtered idling rotational speed injection quantity, and a hysteresis value.

13. The method of controlling the rotational speed according to claim 1, wherein:

when the charge definition is set as dominant, dominance changes to the final rotational speed controlling device when the actual rotational speed of the drive unit is higher than a second limit value.

14. The method of controlling the rotational speed according to claim 13, wherein:

the second limit value is computed from a desired value of a final rotational speed and a rotational speed derivative action; and the rotational speed derivative action is determined substantially by a gradient of the actual rotational speed and a derivative action value.

15. The method of controlling the rotational speed according to claim 13, wherein when the dominance is changed, an I-component of the final rotational speed controlling device is initialized.

16. The method of controlling the rotational speed according to claim 15, wherein the initialization value of the I-component is determined substantially by a gradient of the actual rotational speed.

17. The method of controlling the rotational speed according to claim 2, wherein:

when the final rotational speed controlling device is set at dominant, dominance changes to the charge definition when the charge injection quantity becomes smaller than the difference between the final rotational speed injection quantity or the filtered final rotational speed injection quantity minus the hysteresis value.

18. The method of controlling the rotational speed according to claim 1, wherein:

the charge injection quantity is determined from a characteristic curve or characteristic diagram based on the charge definition and is filtered by means of a filter.

* * * * *